US006653781B2

(12) United States Patent
Bánkuti et al.

(10) Patent No.: US 6,653,781 B2
(45) Date of Patent: Nov. 25, 2003

(54) LOW PRESSURE DISCHARGE LAMP WITH END-OF-LIFE STRUCTURE

(75) Inventors: László Bánkuti, Budapest (HU); István Würsching, Budapest (HU); Norbert Benkó , Tiszaújváros (HU); Ferenc Papp, Budapest (HU)

(73) Assignee: General Electric Company, Schenectady, NY (US)

( * ) Notice: Subject to any disclaimer, the term of this patent is extended or adjusted under 35 U.S.C. 154(b) by 49 days.

(21) Appl. No.: 09/882,240

(22) Filed: Jun. 15, 2001

(65) Prior Publication Data

US 2002/0190647 A1 Dec. 19, 2002

(51) Int. Cl.[7] ..... H01J 61/33

(52) U.S. Cl. ..... 313/573; 313/493; 313/634

(58) Field of Search ..... 313/493, 573, 313/623, 634, 326, 313

(56) References Cited

U.S. PATENT DOCUMENTS

| | | | | |
|---|---|---|---|---|
| 5,182,490 A | * | 1/1993 | Holden et al. | 313/493 |
| 5,210,461 A | | 5/1993 | Pai et al. | |
| 5,446,340 A | | 8/1995 | Parillo et al. | |
| 5,753,999 A | * | 5/1998 | Roozekrans et al. | 313/493 X |
| 5,936,341 A | * | 8/1999 | Koleszar et al. | 313/493 |

* cited by examiner

*Primary Examiner*—Ashok Patel
(74) *Attorney, Agent, or Firm*—Fay, Sharpe, Fagan, Minnich & McKee, LLP

(57) ABSTRACT

A low pressure arc discharge lamp with an end-of-life structure is described. The lamp has a discharge tube with sealed ends, and the sealed ends contain a filament for forming a discharge arc. The filament is supported by lead-in wires. The discharge lamp further comprises a connecting element made of an insulating material which transversely connects the lead-in wires within the discharge tube. The transverse dimension of the connecting element is chosen so as not to allow the discharge arc beyond the connecting element upon end-of-life of the discharge lamp.

15 Claims, 2 Drawing Sheets

LOW PRESSURE DISCHARGE LAMP WITH END-OF-LIFE STRUCTURE

FIELD OF THE INVENTION

This invention relates to a low pressure arc discharge lamp comprising a discharge tube with at least one sealed end. The sealed end contains a filament supported by lead-in wires. The lamp is provided with an end-of-life structure.

BACKGROUND OF THE INVENTION

Low pressure discharge lamps are well known in the art. These lamps exhibit a characteristic failure when the electrode emissive material on at least one of the filaments has been depleted. This form of failure is termed hereinafter as the end-of-life of the lamp. When the emitter material disappears from the filament, the voltage across the lamp increases, and the arc current in the discharge tube dissipates substantially increased power on the electrodes. As a result, unwanted heating effects occur.

Several solutions were suggested to limit this unwanted performance of the lamp. U.S. Pat. No. 5,210,461 discloses a lamp with an end-of-life structure, comprising a filament which is in physical contact with the wall of the discharge tube. When the filament is heated due to the end-of-life effect, the direct heating of the wall causes it to crack. The arc is extinguished by the outer atmosphere entering the discharge tube. This solution has the drawback that the filament scratches off the phosphor coating within the discharge tube which negatively affects the visual appearance of the lamp. Also, the localized heating of the wall may cause excessive fracturing of the discharge tube. Therefore, a further external cover is needed on the end portion of the discharge tube.

U.S. Pat. No. 5,446,340 discloses a discharge lamp which is provided with a structural weakening of the discharge tube. The structural weakening is formed on the pinched ends of the tube. The purpose of the structural weakening is to cause a cracking of the tube when the temperature of the pinched ends surpasses the normal operating temperature. This solution has the drawback that the cracking of the tube occurs only after a relatively long time. During this time the heating of the pinched ends causes the melting of the plastic housing of the lamp. The melting of the plastic may develop irritating smell, and may turn on smoke detector devices, causing false alarm.

Therefore, there is a need for a low pressure discharge lamp which exhibits controlled end-of-life failure in a relatively short time after the depletion of the electron emitting material without causing the melting of the plastic housing, and which lamp may be manufactured economically.

SUMMARY OF THE INVENTION

In an embodiment of the present invention, there is provided a low pressure arc discharge lamp comprising a discharge tube with at least one sealed end. The sealed end contains a filament for forming a discharge arc. The filament is supported by lead-in wires. The discharge lamp further comprises a connecting element which transversally connects the lead-in wires within the discharge tube. This connecting element is made of an insulating material. The transversal dimension of the connecting element is selected so as not to allow the discharge arc beyond the connecting element upon end-of-life of the discharge lamp.

The term "end-of-life", as mentioned above, is defined as the failure of the lamp due to the depletion or disappearance of the electron emitter material from the filament. This failure effect is well known in the art, and it is also described in U.S. Pat. No. 5,210,461.

In a further refinement of the lamp, it is foreseen that the discharge tube comprises a structural weakening in the vicinity of the connecting element. This structural weakening may take different forms, the most expedient being a reduction of the discharge tube wall thickness.

The structural weakening contributes to the guaranteed cracking of the discharge tube when the discharge arc strikes the tube wall. Alternatively, the arc causes the melting of the connecting element, and the tube wall cracks upon physical contact with the hot melted material.

It is suggested to use a lamp configuration where the structural weakening is external to the lamp housing. In this manner, the melting of the lamp housing itself is largely prevented, and the above mentioned negative effects are avoided.

BRIEF DESCRIPTION OF THE DRAWINGS

The invention will be now described with reference to the enclosed drawings, where.

DETAILED DESCRIPTION OF THE INVENTION

Figure 1:
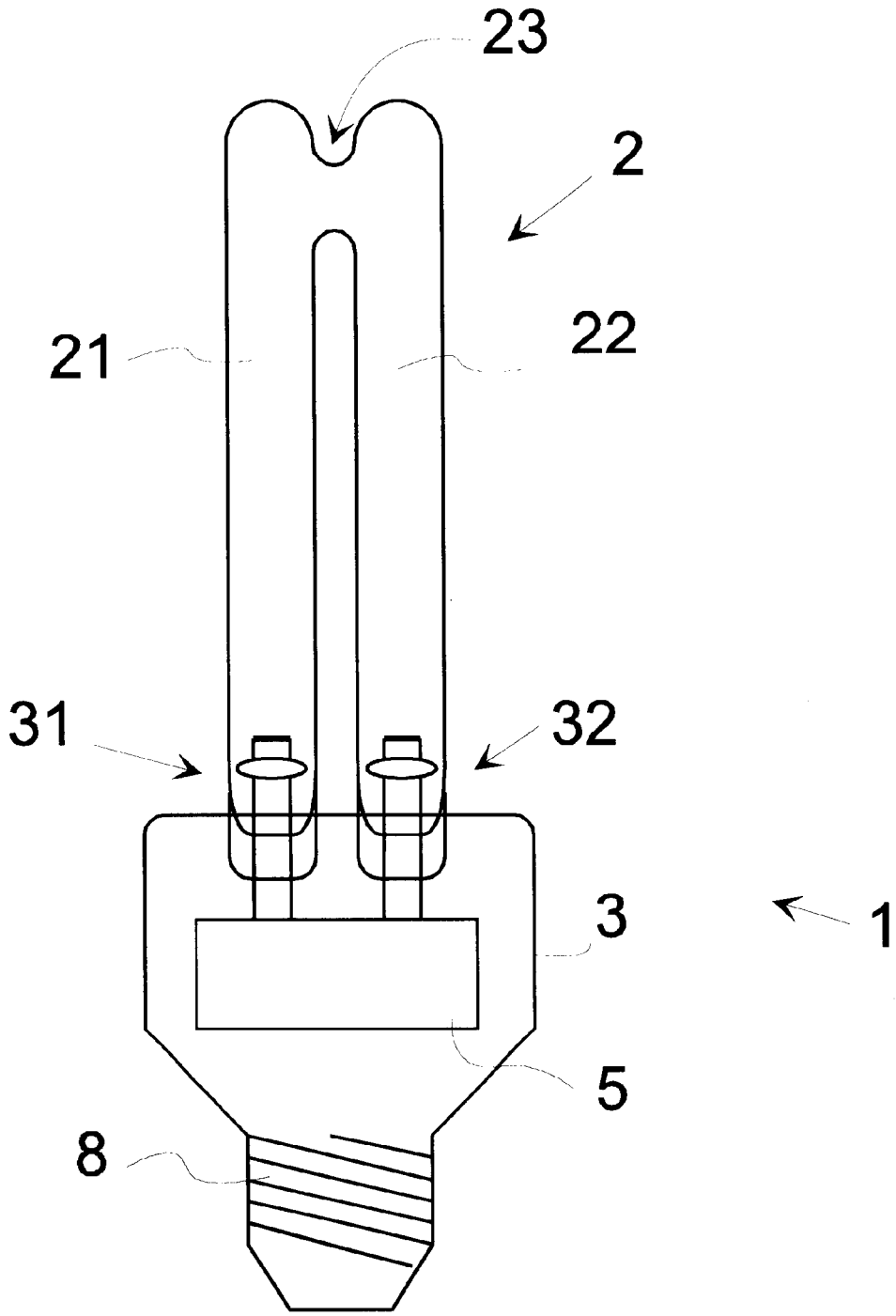
FIG. 1 shows the schematic structure of a low pressure discharge lamp.

Referring now to FIG. 1, there is shown a low pressure arc discharge lamp 1. The lamp 1 has a discharge tube 2 with at least one, normally two or more sealed ends. The lamp 1 of FIG. 1 has two parallel disposed discharge tube sections 21 and 22 which are interconnected through the neck 23 at the upper ends of the tube sections 21 and 22.

The discharge tube 2 is mechanically supported by a lamp housing 3. The lamp housing 3 surrounds at least partly the discharge tube 2. With other words, the lamp housing 3 covers the sealed ends 31,32 of the discharge tube 2. More precisely, the sealed ends 31,32 of the tube sections 21,22 are within the lamp housing 3, while the major part of the tube sections 21,22 is external to the lamp housing 3. The lamp 1 is of a type where light is emitted by a phosphor layer deposited on the inner surface of the discharge tube, the phosphor being excited by a discharge arc. The electrons of the discharge arc are emitted from a heated filament 4. (See also FIGS. 2 and 3.) The filament 4 is contained at the sealed ends 31,32 of the discharge tube 2. The filament 4 is supported by lead-in wires 41,42 Such a discharge lamp arrangement is known by itself. The lamp housing 3 also contains the electronic ballast circuit 5 of the lamp. In a typical embodiment, the lamp housing 3 is equipped with a screw terminal 8 which fits into a standard screw socket (not shown).

There is a further connecting element 6 in the filament arrangement of the lamp 1. This connecting element 6 is made of an insulating material, and it connects the lead-in wires 41,42 transversely within the discharge tube. Typically, this connecting element 6 is made of glass, and it is also customarily referred to as a "glass bead", and its primary function is to provide mutual mechanical support to the lead-in wires 41,42. This support function of such a glass bead is also known, see e.g. U.S. Pat. No. 5,210,461.

In the lamp in which the present invention is embodied, the connecting element 6 also assumes the function of expediting the controlled failure of the lamp on the occurrence of the end-of-life effect. For this purpose, the transverse dimension of the connecting element 6 is chosen so as not to allow the discharge arc to creep beyond the connecting element upon end-of-life of the discharge lamp. The term "transverse dimension" is meant as the dimension transverse to the principal axis of the tube section containing the filament 4 and the connecting element 6. In the shown embodiment, this is the dimension of the connecting element 6 which is substantially perpendicular to the axis of the tube sections 21,22. i.e. the diameter d of the connecting element 6, as will be explained more in detail below.

More precisely, the connecting element 6 is sized so that the discharge arc necessarily strikes either the wall 7 of the discharge tube 2, or the connecting element 6, or both, when the filament 4 and the upper ends 51,52 of the lead-in wires 41,42 have burnt down. The burn-down of the lead-in wires 41,42 follows the depletion of the electron emitting material. In this case, the cathode filament incandesces for a certain amount of time, normally not more than a few minutes or even less, and then breaks. The cathode fall voltage increases, but the ballast circuit still feeds the lamp in spite of the increased lamp voltage. Therefore, the discharge arc is maintained on the remaining cathode rod until the burn-down of the remaining rod, i.e. the upper end 51,52 of the lead-in wires 41,42 in the area of the sealed ends 31,32 of the discharge tube 2. During this process, the voltage absorbed by the lamp increases, and the temperature of the sealed ends 31,32 increases as well. However, the regions of the sealed ends 31,32 between the connecting element 6 and the lamp housing 3 are less heated due to the heat insulating effect of this connecting element 6.

After the burn-down of the upper end of the lead-in wires 41,42, the discharge arc is directed to strike the lower end of the lead in-wires 41,42, i.e. those end which is below the connecting element 6 between the connecting element 6 and the sealed end 31,32. In this case, due to the narrow gap 33 between the inner surface of the wall 7 of the discharge tube 2 and the connecting element 6, the arc effectively impinges on the wall 7.

Alternatively, or simultaneously, the arc continues to strike the remaining upper parts 51,52 of the lead in-wires 41,42, but due to their continuously diminishing size, in effect strikes the connecting element 6.

The lamp 1 shortly thereafter ceases to operate in a controlled manner, because either one, or both of the following effects occur: the wall 7 cracks directly under the heating effect of the discharge arc, or the connecting element 6 melts from the heating effect of the discharge arc. Due to the melting, the connecting element 6 touches the wall 7, and the wall 7 cracks as a result of the sudden thermal stress caused by the melted material. In any case, the ambient air enters the discharge tube 2 through the leak, and the discharge arc is extinguished.

In order to facilitate the controlled cracking of the tube 2, the discharge tube 2 comprises a structural weakening in the vicinity of the connecting element 6. Expediently, the structural weakening is realised in practice as a thinning of the discharge tube wall 7. In practice, from a manufacturing point of view, it is feasible to perform the structural weakening by creating a roughened area 61 on the discharge tube wall 7. Such a roughening is conveniently made with grit blasting or an abrasive disk (friction disk), or alternatively, with a laser heat treatment. These roughening methods are easily integrated into the lamp manufacturing process. The wall thickness reduction caused by the roughening or other type of structural weakening need not impart substantial mechanical weakening to the discharge tube. Since this is done in a region where the wall thickness of the discharge tube 2 is largely uniform and the material is free from stress, the modification practically does not affect the overall mechanical stability of the lamp.

Figure 2:
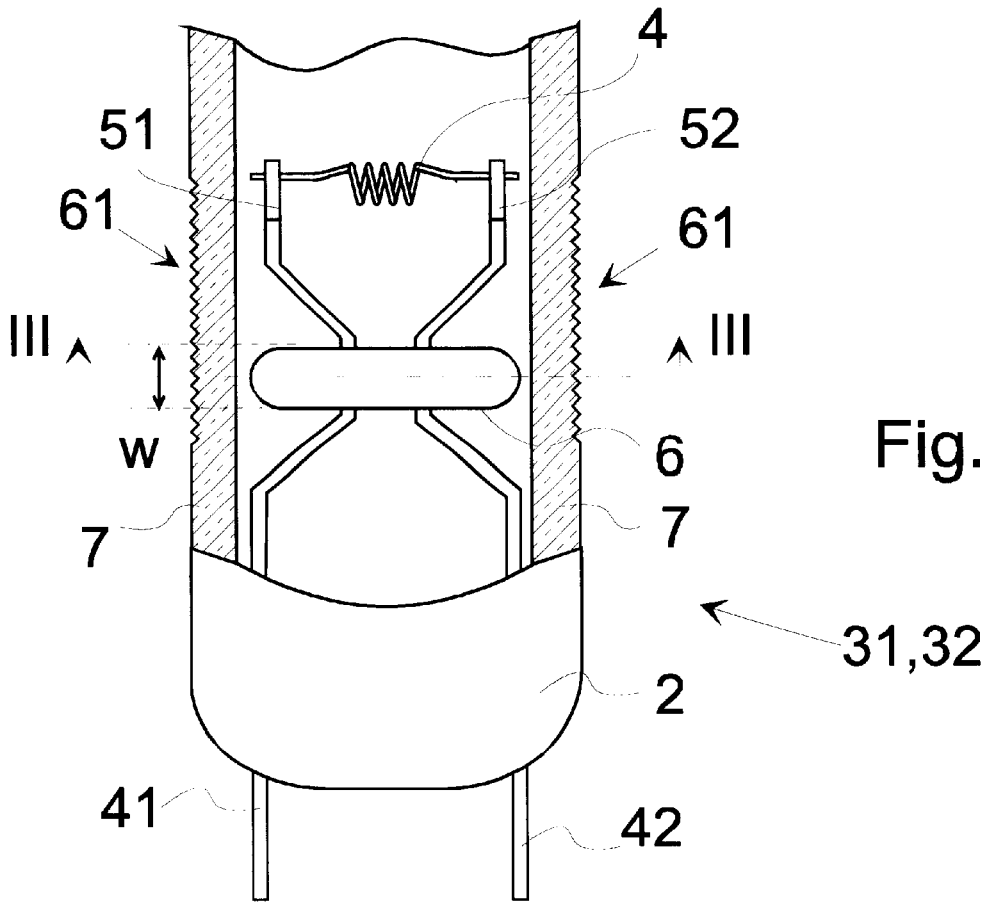
FIG. 2 is an enlarged picture showing an end section of the discharge tube of FIG. 1, partly in cross section, and illustrating the filament configuration.
Figure 3:
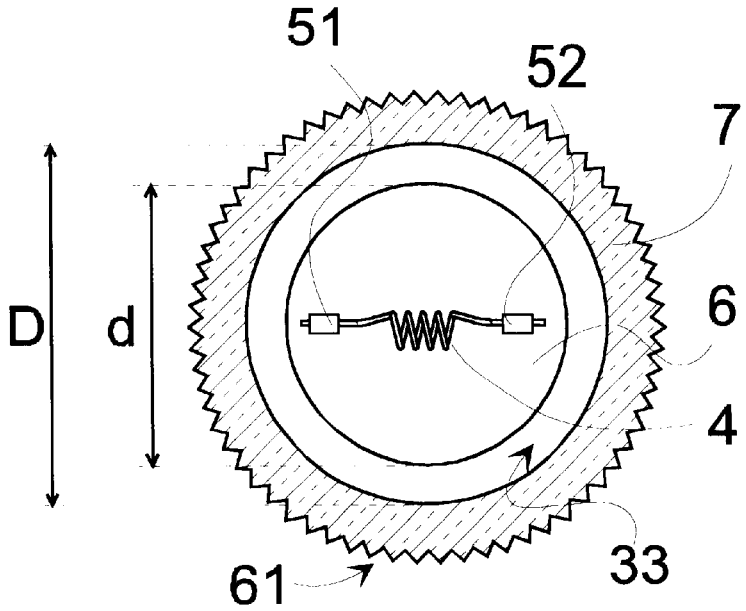
FIG. 3 is another cross section of the end section of the discharge tube, taken along the lines III—II of FIG. 2.

As best seen in FIGS. 2 and 3, the connecting element 6 is substantially disk shaped, however, other substantially circular shapes are also feasible. Apparently, it is preferred that the outer contour of the connecting element 6 conforms to the inner cross-section of the discharge tube 2, at least in the region of the connecting element 6.

In order to ensure an even width of the gap 33, the principal plane of the disk-shaped connecting element 6 is perpendicular to the axis of the discharge tube 2. Considering the usual power density of the discharge arc, it is suggested that the diameter d of the connecting element 6 is not less than 80% of the internal diameter D of the discharge tube. With the usual tube internal diameters of 8–10 mm, this means that the distance between the inner surface of the discharge tube 2 and the connecting element 6, i.e. the width of the gap 33 is not larger than 0.8–1 mm. It is preferable to dimension the gap 33 even smaller, e.g. approx. 0.3 mm, but selecting the gap 33 too narrow would require high precision assembling machinery which in turn would negatively affect the manufacturing costs.

Typically, the thickness w of the connecting element is 1.5–4 times the discharge tube wall thickness, expediently approx. 2–4 mm. As mentioned above, the connecting element may be made of glass. This is the same material as the material of the wall 7, and it has the advantage that no potentially contaminating material need to be in the discharge atmosphere. Also, since the connecting glass bead is normally a part of the filament support structure, the existing manufacturing equipment may be readily modified without significant added costs. Only the dimensions of the already existing glass bead need to be adjusted to the various discharge tube dimensions.

Finally, it is noted that the provision of the properly sized connecting element 6 and the associated structural weakening of the discharge tube 2 allows the cracking and the heat to transfer to a region which is further away from the lamp housing 3. E.g. as best seen in FIG. 2, the roughened part 61 of the discharge tube 2 (indicated by the serrated wall sections on the drawings) is formed on a limited area of the wall only. Typically, the roughened part 61 is not more than 5–10 mm wide along the axial direction of the discharge tube 2. This roughened part 61 part is positioned external to the lamp housing 3, i.e. on those regions of the tube sections 21,22 which are not covered by the lamp housing 3.

The embodiment shown in the figures is a lamp with a terminal which fits into a screw-in type of socket (also called as an Edison-type socket). However, the lamp may have other types of terminal. Notably, a so-called plug-in type of terminal and socket is commonly used with compact fluorescent lamps. It is also known to place the ballast electronics in a housing different from the housing supporting the discharge tube, so that the defunct discharge tube may be discarded, but the expensive electronics components of the ballast can be used further with another discharge tube. In this case, there is also a socket-type connection between the two housings, facilitating the replacement of the discharge tube.

The invention is not limited to the shown and disclosed embodiments, but other elements, improvements and variations are also within the scope of the invention. As an example, lamps with more than two parallel tube sections are also suitable to be equipped with the described end-of-life structure. In the case of such lamps, the roughening may be done conveniently with an abrasive disk or laser beam, because only those tube sections need to be treated which contain a filament structure.

What is claimed is:

1. A low pressure arc discharge lamp comprising:

a discharge tube with at least one sealed end and containing a filament for forming a discharge arc, the filament being supported by a pair of spaced-apart lead-in wires; and, a connecting element made of an insulating material, the connecting element intermediately supported on the lead-in wires between the filament and the sealed end such that the lead-in wires are transversely connected thereby within the discharge tube;

the discharge tube having a structural weakening in the vicinity of the connecting element.

2. The discharge lamp of claim 1 in which the structural weakening is a thinning of the discharge tube wall.

3. The discharge lamp of claim 1 in which the connecting element is substantially disk shaped.

4. The discharge lamp of claim 3 in which the principal plane of the disk is perpendicular to the axis of the discharge tube.

5. The discharge lamp of claim 3 in which the diameter of the connecting element is not less than 80% of the internal diameter of the discharge tube.

6. The discharge lamp of claim 3 in which the thickness of the connecting element is about 1.5 to about 4 times the discharge tube wall thickness.

7. The discharge lamp of claim 1 in which the connecting element is made of glass.

8. The discharge lamp of claim 1 in which the structural weakening is a roughening of the discharge tube wall.

9. A low pressure arc discharge lamp comprising a discharge rube with at least one sealed end, the sealed end containing a filament for forming a discharge arc, the filament being supported by lead-in wires, and further comprising a connecting element made of an insulating material, the connecting element transversely connecting the lead-in wires within the discharge tube, the transverse dimension of the connecting element being chosen so as not to allow the discharge arc beyond the connecting element upon end-of-life of the discharge lamp, the discharge tube including a structural weakening in the vicinity of the connecting element formed by a roughening of the discharge tube wall.

10. The discharge lamp of claim 9 in which the roughening is made with grit blasting.

11. The discharge lamp of claim 9 in which the roughening is made with an abrasive disk.

12. The discharge lamp of claim 9 in which the roughening is made with laser heat treatment.

13. A low pressure arc discharge lamp comprising:

a discharge tube with at least one sealed end and containing a filament for forming a discharge arc, the filament being supported by a pair of spaced-apart lead-in wires; and, a connecting element made of an insulating material, the connecting element intermediately supported on the lead-in wires between the filament and the sealed end such that the lead-in wires are transversely connected thereby within the discharge tube, the distance between the inner surface of the discharge tube and the connecting element being not less than 0.3 mm.

14. A low pressure arc discharge lamp comprising a discharge tube with at least one sealed end, the sealed end containing a filament for forming a discharge arc, the filament being supported by lead-in wires, and further comprising a connecting element made of an insulating material, the connecting element transversely connecting the lead-in wires within the discharge tube, the transverse dimension of the connecting element being chosen so as not to allow the discharge arc beyond the connecting element upon end-of-life of the discharge lamp, the discharge tube including a plurality of parallel disposed, interconnected discharge tube sections.

15. The discharge lamp of claim 14 in which the lamp comprises a lamp housing which surrounds at least partly at least one discharge tube section, and the structural weakening is external to the lamp housing.

* * * * *